US006056133A

United States Patent [19]

Luenser

[11] Patent Number: 6,056,133

[45] Date of Patent: May 2, 2000

[54] DISPLAY DEVICE AND STORAGE RACK COMPONENT HAVING A HANGING MEMBER AND A RESTING MEMBER INTEGRALLY FORMED WITH AND REMOVABLE FROM THE COMPONENT

[76] Inventor: Carl D. Luenser, 12757 Mozart St., Blue Island, Ill. 60406-1920

[21] Appl. No.: 08/909,473

[22] Filed: Aug. 11, 1997

Related U.S. Application Data

[63] Continuation-in-part of application No. 08/489,148, Jun. 9, 1995, Pat. No. 5,685,439, and a continuation-in-part of application No. 08/825,906, Apr. 2, 1997, Pat. No. 5,853,091.

[51] Int. Cl.[7] ..... A47F 5/00; A47G 29/00

[52] U.S. Cl. ..... 211/183; 211/40; 211/194; 211/88.01

[58] Field of Search ..... 211/40, 194, 183, 211/88.01, 71.01, 2; 248/909, 126, 470, 467; 40/757, 788, 786

[56] References Cited

U.S. PATENT DOCUMENTS

| | | | |
|---|---|---|---|
| Re. 22,683 | 10/1945 | Piper | 40/788 X |
| 2,581,733 | 1/1952 | Trask | 40/786 |
| 2,651,867 | 9/1953 | Prew | 40/757 X |
| 3,650,382 | 3/1972 | Braun et al. . | |
| 4,074,810 | 2/1978 | Juergens et al. | 211/11 |
| 4,094,271 | 6/1978 | Louis | 119/245 |
| 4,165,572 | 8/1979 | Sussman . | |
| 4,175,691 | 11/1979 | Cornell et al. | 206/509 |
| 4,333,573 | 6/1982 | Holoubek | 211/11 |
| 4,594,802 | 6/1986 | Field . | |
| 4,712,679 | 12/1987 | Lowe . | |
| 4,756,498 | 7/1988 | Frye | 248/205.3 |
| 4,768,655 | 9/1988 | MacGregor | 211/11 |
| 4,781,292 | 11/1988 | Sacherman et al. . | |
| 4,940,150 | 7/1990 | Spengler . | |
| 5,027,961 | 7/1991 | Howitt | 211/188 |
| 5,038,927 | 8/1991 | Bell . | |
| 5,040,316 | 8/1991 | Fast | 40/124.4 |
| 5,040,687 | 8/1991 | Whittington . | |
| 5,048,702 | 9/1991 | Maloney | 211/194 |
| 5,061,102 | 10/1991 | Rennie | 401/98 |
| 5,191,983 | 3/1993 | Hardy | 211/40 |
| 5,331,756 | 7/1994 | Rehrig . | |
| 5,335,795 | 8/1994 | Chizen . | |
| 5,365,417 | 11/1994 | Chen . | |
| 5,384,103 | 1/1995 | Miller | 422/310 |
| 5,392,913 | 2/1995 | Merrick . | |
| 5,442,873 | 8/1995 | Vogler . | |
| 5,462,177 | 10/1995 | O'Donnell . | |
| 5,577,620 | 11/1996 | Jacob . | |
| 5,584,398 | 12/1996 | Lin . | |
| 5,641,074 | 6/1997 | Smed | 211/11 |
| 5,667,287 | 9/1997 | Gunning et al. | 312/108 |
| 5,676,262 | 10/1997 | Justice et al. | 211/49.1 |
| 5,685,439 | 11/1997 | Luenser . | |
| 5,697,500 | 12/1997 | Walker | 206/509 |
| 5,746,325 | 5/1998 | Lee | 211/40 |
| 5,839,650 | 11/1998 | Sheffer | 229/120.11 |

*Primary Examiner*—Daniel P. Stodola
*Assistant Examiner*—Gregory J. Strimbu
*Attorney, Agent, or Firm*—Richard L. Miller, P.E. Registered Patent Agent

[57] ABSTRACT

A combination display device and storage rack component that is made of a transparent plastic so as to allow complete visibility of a CD jewel box housed therein and is either hung on a vertical wall or rested inclined on a horizontal surface. The component includes a base, a pair of side walls, a hanging apparatus, a resting apparatus, and a stacking and interlocking apparatus. The pair of side walls extend upwardly from the base. The hanging apparatus is for hanging the combination display device and storage rack component on the vertical wall. The resting apparatus is for supporting the combination display device and storage rack component inclined on the horizontal surface. The stacking and interlocking apparatus is for stacking and interlocking a plurality of the combination display device and storage rack components in a staggered arrangement. The hanging apparatus and the resting apparatus are disposed in a cutout in the base and are integrally formed with the base, Runners connect the hanging apparatus and the resting apparatus to the base and allow them to be detached when their use is desired.

11 Claims, 2 Drawing Sheets

FIG. 1
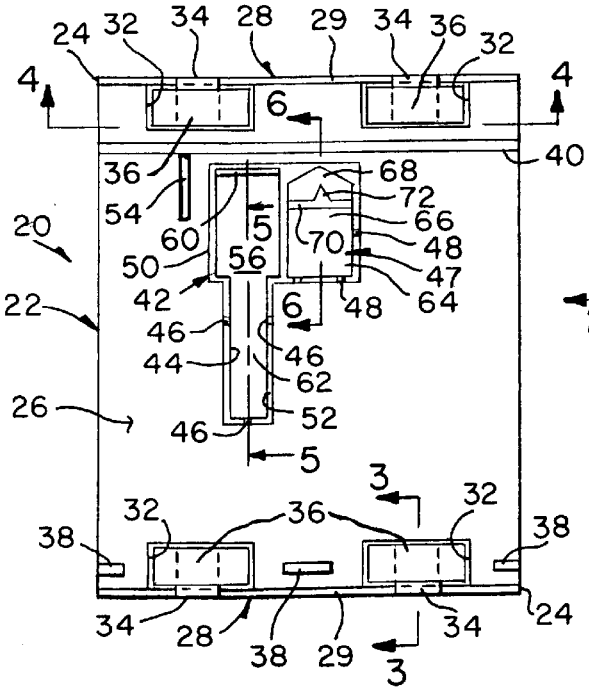
FIG. 2
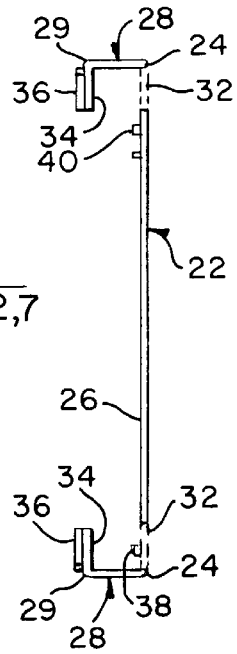
FIG. 5
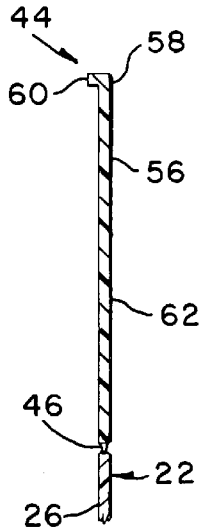
FIG. 3
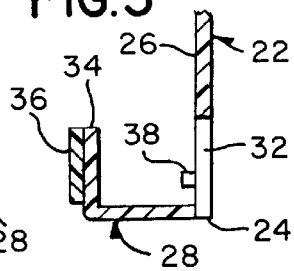
FIG. 4
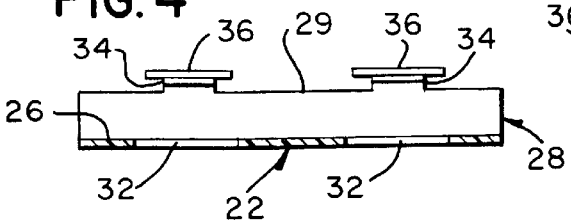
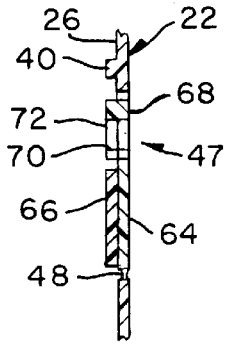
FIG. 6
FIG. 11
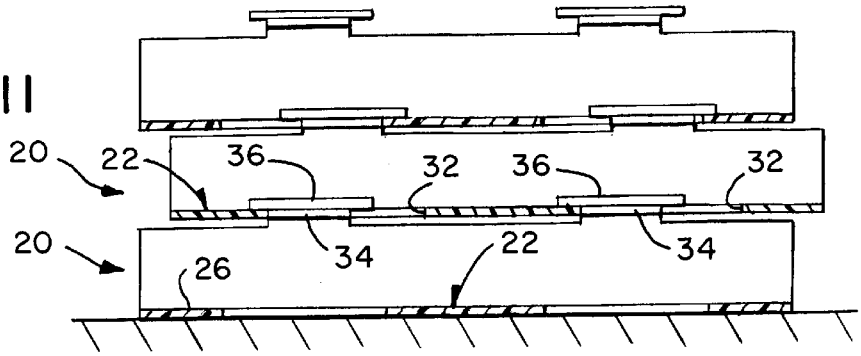

DISPLAY DEVICE AND STORAGE RACK COMPONENT HAVING A HANGING MEMBER AND A RESTING MEMBER INTEGRALLY FORMED WITH AND REMOVABLE FROM THE COMPONENT

CROSS REFERENCE TO RELATED APPLICATIONS

The instant application is a continuation-in-part of the following two copending applications:

1. U.S. Ser. No. 08/489,148 filed on Jun. 9, 1995 for Display Frame/Interlocking Storage Rack Component which matured into U.S. Pat. No. 5,685,439 issued on Nov. 11, 1997; and
2. U.S. Ser. No. 08/825,906 filed on Apr. 2, 1997 for Improved Display Frame/Interlocking Storage Rack Component which matured into U.S. Pat. No. 5,853, 091 issued on Dec. 29, 1998.

BACKGROUND OF THE INVENTION

1. Field of the Invention

The present invention relates to a rack component. More particularly, the present invention relates to a display device/storage rack component.

2. Description of the Prior Art

Numerous innovations for storage rack components have been provided in the prior art that wilt be described. Even though these innovations may be suitable for the specific individual purposes to which they address, however, they differ from the present invention.

FOR EXAMPLE, U.S. Pat. No. 3,650,382 to Braun et al. teaches an improved molded plastic display package. The package includes a first elongated member having an I-beam type cross section and a second U-shaped member that is slidable onto and off of the first member and which includes releasable latch means for engagement with a portion of the first member. Terminal means are provided for mounting and displaying an article of jewelry, for example, with the aid of an elastic extension. The present invention requires a relatively shallow mold.

ANOTHER EXAMPLE, U.S. Pat. 3,655,065 to Yellin teaches a knockdown cube member formed of a plastic material. The member includes a top member and a bottom member each integrally formed and being of identical construction and a pair of side members being of identical construction, so that the top, bottom and side member may be readily assembled to form a cube. The cube may be used either individually or to form a module which is readily connected to other similar cubes.

STILL ANOTHER EXAMPLE, U.S. Pat. No. 3,907,116 to Wolf et al. teaches a holder for both boxed and unboxed magnetic tape cassettes. The holder is formed as a rack with shelves sloping down and rearwardly for supporting the ends of the boxed cassettes. The shelves are cut away to define nesting recesses to hold the smaller unboxed cassettes with the fronts thereof in the same vertical plane as the fronts of the boxed cassettes.

YET ANOTHER EXAMPLE, U.S. Pat. No. 4,165,572 to Sussman teaches a display stand for holding an advertisement or other notice in sheet form in an upright position on a counter or desk. The stand is constituted by a pair of complementary pieces each formed by a transparent panel having a right-angle ledge extending from its lower end so that when the two panels are brought together to sandwich a display sheet therebetween, the a ledges which extend in opposite directions then define a base to support the panels in an upright position. Each panel, just above the junction of its lower end and ledge, is provided with interlocking elements in the form of a rectangular slot and a companion tongue which projects in a direction opposite to the ledge direction. When the panels are brought together, the tongue of one fits neatly into the slot of the other. Each tongue has an edge notch therein making it possible to slide one panel relative to the other to a position at which the panels are then coincident with each other and are interlocked.

STILL YET ANOTHER EXAMPLE, U.S. Pat. No. 4,594, 802 to Field teaches a display device that uses a generally transparent cardholder member that is detachably mounted to a base member. The cardholder member is formed of a pair of plates maintained in a spaced coplanar orientation by plural pin and hole assemblies. A ledge is provided adjacent the lower edge of each of the plates that is adapted to support a display card thereon while the plural pin and hole assemblies additionally provide an auxiliary support surface adapted to mounted supplemental header cards.

YET STILL ANOTHER EXAMPLE, U.S. Pat. No. 4,781, 292 to Sacherman et al. teaches an apparatus capable of storing or displaying a plurality of compact discs, cassettes or other similar objects. The apparatus includes a housing and a plurality of pivotable members rotatably positioned therein. Each pivotable member may hold one or more objects, each object being positioned within a compartment in the pivotable member. In one embodiment, each pivotable member includes a base plate, a rear wall, a pair of side walls, and a pair of members which together form a front wall. The front wall members cooperate with the rear wall, which may include clamping ribs, to provide a clamping force which substantially fixedly positions the compact discs within the pivotable member so that the display rack may be positioned throughout a range extending from substantially horizontal to substantially vertical. The clamping force may be adjusted by varying the dimensions and geometry of a slot associated with the clamping means.

STILL YET ANOTHER EXAMPLE, U.S. Pat. No. 4,940, 150 to Spengler teaches a modular storage rack constructed of a plastic resin and will not corrode or rust. The storage rack is easily assembled and disassembled as it uses only a friction fit to retain the structural elements in position.

YET STILL ANOTHER EXAMPLE, U.S. Pat. No. 5,038, 927 to Bell teaches a display case designed to show small objects which are suitable for card mounting. The case has a transparent conduit with a closed end and an open end. Cards on which jewelry or other merchandise is mounted are inserted into the conduit through the open end. In one preferred embodiment a clip having a slot is employed to hold the cards. In another preferred embodiment a second spaced apart slot is provided for insertion of a second set of cards which doubles the display capacity. Support for the card array is provided in one embodiment by one or more protrusions extend into the tube on which the card array rests. These protrusions extend into the tube and provide maximum distance to the wall of the tube which is less than the width of the card array. The protrusions provide support for the vertical array of cards and can be indentations in the wall of the tube. In another embodiment of the invention a rod passing through the wall of the tube is employed as the support for the vertical array of cards. Lockable caps are preferably employed to hold the rod in position. A hanger is provided which attaches to the closed end of the conduit to allow the display case to be hung eliminating the need for counter space. It is preferred that the hanger is rotatably mounted so that the display case can be rotated.

STILL YET ANOTHER EXAMPLE, U.S. Pat. No. 5,048, 702 to Maloney teaches a transportable rack for handling bakery goods such as bread which is made of moldable plastic. The rack has a base trolley on which are mounted modular stackable shelf units having longitudinally extending parallel side rails adapted to hold bakery goods for transport and separating members outboard each shelf unit which provide vertical separation between the shelves and transmit the weight of the shelf and its contents downward so that each shelf is light. The separating members form a vertical load-bearing and bracing column on each side of the rack.

YET STILL ANOTHER EXAMPLE, U.S. Pat. No. 5,191, 983 to Hardy teaches a modular storage rack for CD jewel boxes, or the like. The rack comprises individual tray units that are stackable vertically and connectable laterally. The tray itself has no moving parts but only a ribbon spring which acts to both secure the jewel box when inserted and eject the same when retrieval is desired. Release of the jewel box is obtained by inward pressure against the spring and rotation of the box about a fulcrum on one of the tray walls, permitting the spring to urge the box out of the tray.

STILL YET ANOTHER EXAMPLE, U.S. Pat. No. 5,253, 751 to Wipper teaches a package for the retail display of a compact disc that includes a base hingedly connected to the cover of a conventional jewel box, and a tray in which the disc is removably stored by a circular array of flexible fingers. A narrow slot is formed in the elevated portion which extends along its entire length.

YET STILL ANOTHER EXAMPLE, U.S. Pat. No. 5,285, 907 to Franchere et al. teaches racks or tray arrays for use in clinical laboratories, in particular, to support tubes and other containers holding body fluid specimens. The invention allows the user to "build" racks or arrays of larger and/or smaller capacity, depending upon the user's requirements, by rapid snapping together of a plurality of identical modular tube units. The racks or units may have a variety of size openings for accommodating different size specimen containers, and containers of different configuration. Thus, the user can maintain stable support of a great many containers simultaneously for handling in the laboratory, thus avoiding the danger of dropping or spilling specimens. The arrangements of the invention may be comprised of reusable, autoclavable moldable plastic materials, or less expensive throw away moldable materials. The individual components making up the tube rack array may be of a variety of geometric configurations.

STILL YET ANOTHER EXAMPLE, U.S. Pat. No. 5,289, 918 to Dobias et al. teaches an unitary sheet storage container for a compact disc. The container has a disc holder panel that enables the insertion of a compact disc down into the disc holder panel which holds the disc at four points on its outer periphery.

YET STILL ANOTHER EXAMPLE, U.S. Pat. No. 5,289, 925 to Newmark teaches a display for organizing cases of compact discs which allows viewing of a part of only the front face of the package.

STILL YET ANOTHER EXAMPLE, U.S. Pat. No. 5,295, 577 to Minter teaches an upwardly opening tray for storing compact disc packages. Cooperatively interactive guide formations are defined by the tray and the disc holders.

YET STILL ANOTHER EXAMPLE, U.S. Pat. No. 5,331, 756 to Rehrig teaches walls of shopping cart baskets, advertising panels which include a plate element and a frame element which fits on the plate element and is releasibly held in place thereon by a tab-and-slot arrangement. When held in place, a slot and a card display area which is encircled by the frame element are formed between the plate and frame elements. An advertisement display card can then be easily slid into and out of the display area through this slot. Projections on at least one of the elements keep the card from falling out of place when in the area. Retrofitted and molded-in panel versions are disclosed. Plate elements of the retrofitted version can be secured together on the inside and outside of the basket wall providing inwardly and outwardly disposed display areas. The molded-in panel has its plate element molded with anti-recesses in from the outer surface of a wall of the plastic cart basket, and thus when positioned centrally on a basket side wall with the frame element held thereon, the panel does not prevent the carts from nesting. The frame element of the molded-in version, however, is preferably identical to that of the retrofitted version and is also releasibly retained in position using tabs and slots. The frame anti-plate elements are both symmetrical about their longitudinal axes.

STILL YET ANOTHER EXAMPLE, U.S. Pat. No. 5,365, 417 to Chen teaches a combination lighting fixture and rack. The combination includes a lamp installed on a top portion of a rack having a plurality of ribs juxtapositionally disposed on a right and a left side portion of a central column of the rack for inserting a plurality of compact disks (CDs) or cassette tapes on the ribs of the rack, and a lamp shade mounted on the lamp, whereby upon powering of the lamp to create a thermosyphon for drafting air streams around the lamp for ventilating the disks or tapes held on the rack for preventing mildew of the disks and tapes for a hygienic purpose besides an illumination purpose of the lamp.

YET STILL ANOTHER EXAMPLE, U.S. Pat. No. 5,392, 913 to Merrick teaches a storage holder for computer disks, CDs, records, tape cassettes and the like that is formed of a single unitary piece of molded plastic. The holder itself has a rectangular main body. A projecting shelf is located adjacent the bottom of the main body, with a pair of spaced-apart resilient fingers biased inwardly toward the main body member. First and second guides, in the form of raised ribs, pins or flanges, extend along at least a portion of each of the sides of the storage holder, so that when a relatively thin flat object, such as a computer disk, CD or the like, is placed in the storage holder, the resilient fingers bias it against the main body. The shelf at the bottom supports the bottom of the object being stored, and the ribs along the sides provide lateral support. An object, such as a computer disk, CD or the like, readily may be inserted into the storage holder and removed therefrom. A provision is made at the bottom of the storage holder for facilitating pivotal mounting of the storage holder in a container, along with other storage holders.

STILL YET ANOTHER EXAMPLE, U.S. Pat. No. 5,442, 873 to Vogler teaches a unitary injection-molded plastic holder frame for displaying an advertising placard or the like. The frame has four frame sides connected at their ends into a rectangle, a contiguous trio of the sides having generally coplanar mutually directed shallow channels therein for receiving the side margins along three sides of the placard with the remaining frame side being slotted along its length to separate that side into two parallel frame strip. The slot is in coplanar relation to the shallow channels and communicates at its ends with the corresponding ends of the channels in two opposite frame sides whereby the placard can be inserted via the slot into the frame with the margins of its three sides orotruding into the channels. Detent means is provided for positively retaining the placard in its inserted position within the frame, in the form of at least one nib carried on an inner face of at least one of the frame strips projecting toward the opposite strip substantially into contact with the inner face of the opposite strip face and preventing the accidental passage of the placard through the slot. Preferably, each nib has an inclined edge extending from a point adjacent the inner side of the frame strip to a point adjacent its outer side and sloping in the direction from the inner to the outer side toward the opposite frame strip. The inclined edge facilitates the intentional passage of the placard past the nibs for removal from the frame.

FINALLY, YET STILL ANOTHER EXAMPLE, U.S. Pat. No. 5,584,398 to Lin teaches a CD storage rack and lamp assembly that includes a base, a base covering covered on the base, four sets of connecting rods respectively connected in series by connectors, a lamp stand connected to the base and the base covering by the connecting rods, a plurality of telescopic arms connected between the lamp holder and the lamp stand, and a plurality of CD carrier plates fastened to the connecting rods at different elevations between the lamp stand and the base covering.

It is apparent that numerous innovations for storage rack components have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a display device/storage rack component that avoids the disadvantages of the prior art.

ANOTHER OBJECT of the present invention is to provide a display device/storage rack component that is simple and inexpensive to manufacture.

STILL ANOTHER OBJECT of the present invention is to provide a display device/storage rack component that is simple to use.

BRIEFLY STATED, YET ANOTHER OBJECT of the present invention is to provide a display device/storage rack component that is transparent plastic so as to allow complete visibility of a CD jewel box housed therein and being either hung on a vertical wall or rested inclined on a horizontal surface. The component includes a base, a pair of side walls, hanging apparatus, resting apparatus, and stacking and interlocking apparatus. The pair of side walls extend upwardly from the base. The hanging apparatus hangs the display device/storage rack component on the vertical wall. The resting apparatus rests the display device/storage rack component inclined on the horizontal surface. The stacking and interlocking apparatus stacks and interlocks a plurality of the display device/storage rack components. The hanging apparatus and the resting apparatus are disposed in a cutout in the base and are integrally formed with the base by runners that allow them to be detached.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic top plan view of the present invention;

FIG. 2 is a diagrammatic side elevational view taken generally in the direction of arrow 2 in FIG. 1;

FIG. 3 is an enlarged cross sectional view, with parts broken away, taken on line 3—3 in FIG. 1, and illustrating an overhanging ledge and aligned notch;

FIG. 4 is a cross sectional view taken on line 4—4 in FIG. 1, illustrating a pair of overhanging ledges and aligned notches;

FIG. 5 is an enlarged cross sectional view, with parts broken away, taken on line 5—5 in FIG. 1, and illustrating the easel stand of the present invention;

FIG. 6 is an enlarged cross sectional view, with parts broken away, taken on line 6—6 in FIG. 1, and illustrating the wall hanger of the present invention;

FIG. 11 is an enlarged cross sectional view taken on line 11—11 in FIG. 10.

LIST OF REFERENCE NUMERALS UTILIZED IN THE DRAWING

Figure 7:
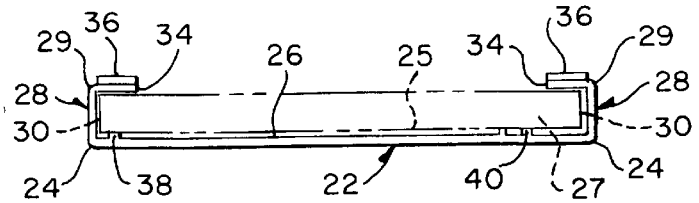
FIG. 7 is a diagrammatic side elevational view taken generally in the direction of arrow 7 in FIG. 1, illustrating the present invention housing a jewel box therein.

| | |
|---|---|
| 20 | display device/storage rack component of the present invention |
| 22 | base |
| 24 | pair of opposing edges of base 22 |
| 25 | viewing surface 25 of object 27 |
| 26 | inner surface of base 22 |
| 27 | object |
| 28 | pair of side walls |
| 29 | free edge of each side wall of pair of side walls 28 |
| 30 | pair of opposing viewing edges of object 27 |
| 32 | two pair of notches in base 22 |
| 34 | two pair of brackets |
| 36 | two pair of overhanginq ledges |
| 38 | three spaced-apart support ridges |
| 40 | continuous support ridge |
| 42 | specifically configured cutout in base 22 |
| 44 | easel stand in specifically configured cutout 42 in base 22 |
| 46 | easel stand runners of easel stand 44 in specifically configured cutout 42 in base 22 |
| 46 | wall hanger in specifically configured cutout 42 in base 22 |
| 48 | wall hanger runners of wall hanger 47 in specifically configured cutout 42 in base 22 |
| 50 | wide portion of specifically configured cutout 42 in base 22 |
| 52 | narrow portion of specifically configured cutout 42 in base 22 |
| 54 | easel stand slot in base 22 |
| 56 | wide portion of easel stand 44 in specifically configured cutout 42 in base 22 |
| 58 | edge of wide portion 56 of easel stand 44 in specifically configured cutout 42 in base 22 |
| 60 | easel stand ridge on edge 58 of wide portion 56 of easel stand 44 in specifically configured cutout 42 in base 22 |
| 62 | narrow portion of easel stand 44 in specifically configured cutout 42 in base 22 |
| 64 | body portion of wall hanger 46 |
| 66 | double faced adhesive pad on body portion 64 of wall hanger 46 |
| 68 | nose portion of wall hanger 46 |
| 70 | wall hanger ridge of wall hanger 46 |
| 72 | wall hanger nose ridge of wall hanger 46 |

-continued

| | |
|---|---|
| 74 | vertical wall |
| 76 | horizontal surface |

DETAILED DESCRIPTION OF THE PREFERRED EMBODIMENT

Referring now to the figures in which like numerals indicate like parts, and particularly to FIG. 1, the display device/storage rack component of the present invention is shown generally at 20, integrally formed of transparent plastic so as to allow an object housed therein to be completely visible.

The configuration of the display device/storage rack component 20 can best be seen in FIGS. 1–7, and as such will be discussed with reference thereto.

The display device/storage rack component 20 includes a base 22 that is thin, flat, and generally rectangular-shaped.

The base 22 has a pair of opposing edges 24 and an inner surface 26 that faces a viewing surface 25 of an object 27 housed in the display device/storage rack component 20 when the display device/storage rack component 20 is being utilized.

The base 22 further has two pair of notches 32 therein that are spaced-apart and rectangular-shaped. Each pair of notches of the two pair of notches 32 in the base 22 opens into a respective edge of the pair of opposing edges 24 of the base 22.

The display device/storage rack component 20 further includes a pair of side walls 28 that are generally rectangular-shaped. Each side wall of the pair of side walls 28 extends perpendicularly upwardly from a respective edge of the pair of opposing edges 24 of the base 22, and faces a pair of opposing viewing edges 30 of the object 27 housed in the display device/storage rack component 20 when the display device/storage rack component 20 is being utilized, and terminates in a free edge 29.

The display device/storage rack component 20 further includes two pair of brackets 34 that are L-shaped. Each pair of brackets of the two pair of brackets 34 extend slightly upwardly from the free edge 29 of a respective side wall of the pair of side walls 28 and then inwardly as inward portions that are in alignment with a respective pair of notches of the two pair of notches 32 in the base 22.

The display device/storage rack component 20 further includes two pair of overhanging ledges 36 that are rectangular-shaped and slightly smaller than the two pair of notches 32 in the base 22. Each overhanging ledge of the two pair of overhanging ledges 36 extends across the inward portion of a respective bracket of the two pair of brackets 34, in alignment with a respective notch of the two pair of notches 32 in the base 22.

The display device/storage rack component 20 further includes three spaced-apart support ridges 38 that are aligned and generally rectangular-parallelepiped-shaped.

The three spaced-apart support ridges 38 are disposed on the inner surface 26 of the base 22, parallel to and spaced slightly inwardly from one edge of the pair of opposing edges 24 of the base 22, and support one end of the viewing surface 25 of the object 27 housed in the display device/storage rack component 20 when the display device/storage rack component 20 is being utilized.

One ridge of the three spaced-apart support ridges 38 is disposed between a respective pair of notches of the two pair of notches 32 in the base 22, and another ridge of the three spaced-apart support ridges 38 is disposed outboard of each notch of the respective pair of notches of the two pair of notches 32 in the base 22.

The display device/storage rack component 20 further includes a continuous support ridge 40 that is generally rectangular-parallelepiped-shaped, and disposed on and extends across the entire width of the inner surface 26 of the base 22, is parallel to and spaced slightly inwardly from a pair of notches of the two pair of notches 32 in the base 22 that open is into another edge of the pair of opposing edges 24 of the base 22, and supports another end of the viewing surface 25 of the object 27 housed in the display device/storage rack component 20 when the display device/storage rack component 20 is being utilized.

The base 22 further has a specifically configured cutout 42 therein that contains an easel stand 44 that is detachable therefrom by easel stand runners 46 so as to allow the easel stand 44 to be integrally formed with the base 22.

The specifically configured cutout 42 in the base 22 further contains a wall hanger 47 that is detachable therefrom by wall hanger runners 48 so as to allow the wall hanger 47 to be integrally formed with the base 22.

The specifically configured cutout 42 in the base 22 has a wide portion 50 that is rectangular-shaped and disposed slightly inwardly of the continuous support ridge 40, near a center thereof.

The specifically configured cutout 42 in the base 22 further has a narrow portion 52 that is rectangular-shaped and narrower than the wide portion 50 of the specifically configured cutout 42 in the base 22, and extends from close proximity of one edge of the wide portion 50 of the specifically configured cutout 42 in the base 22.

The base 22 further has an easel stand slot 54 therein that originates at the continuous support ridge 40, and is slightly spaced from and extends parallel to the one edge of the wide portion 50 of the specifically configured cutout 42 in the base 22.

The configuration of the easel stand 44 can best be seen in FIGS. 1 and 5, and as such will be discussed with reference thereto.

The easel stand 44 is flat and substantially T-shaped and has a wide portion 56 that is generally rectangular-shaped and positioned adjacent to the one edge of and fills a portion of the wide portion 50 of the specifically configured cutout 42 in the base 22.

The wide portion 56 of the easel stand 44 has an edge 58 that is parallel to the continuous support ridge 40, from which an easel stand ridge 60 inwardly extends in the direction of and of the substantially same height as the continuous support ridge 40.

The easel stand 44 further has a narrow portion 62 that is generally rectangular-shaped and extends coplanarly and integrally from and is narrower than the wide portion 56 of the easel stand 44, and substantially fills the narrow portion 52 of the specifically configured cutout 42 in the base 22, and on which the easel stand runners 46 are disposed.

The configuration of the wall hanger 47 can best be seen in FIGS. 1 and 6, and as such will be discussed with reference thereto.

The wall hanger 47 is disposed adjacent to the wide portion 56 of the easel stand 44, and substantially fills a remaining portion of the wide portion 50 of the specifically configured cutout 42 in the base 22.

The wall hanger 47 has a body portion 64 that is generally square-shaped, and on which the wall hanger runners 48 are disposed.

The body portion 64 of the wall hanger 47 has an inner surface that is coplanar with the inner surface 26 of the base 22, and has adhered thereon over a majority thereof a double faced adhesive pad 66.

The wall hanger 47 further has a nose portion 68 that is generally triangular-shaped and extends coplanarly and integrally from the body portion 64 of the wall hanger 47, toward the continuous support ridge 40.

The wall hanger 47 further has a wall hanger ridge 70 that is rectangular-parallelepiped-shaped, parallel to and of the substantially same height as the continuous ridge 40, disposed on the inner surface of the body portion 64 of the wall hanger 47, and extends across the entirety of the wall hanger 47, at the meeting of the body portion 64 of the wall hanger 47 and the nose portion 68 of the wall hanger 47.

The wall hanger 47 further has a wall hanger nose ridge 72 that is triangular-shaped, and extends coplanarly and integrally from and is of the same height as the wall hanger ridge 70 of the wall hanger 47, at its midpoint, toward the nose portion 68 of the wall hanger 47.

Figure 8:
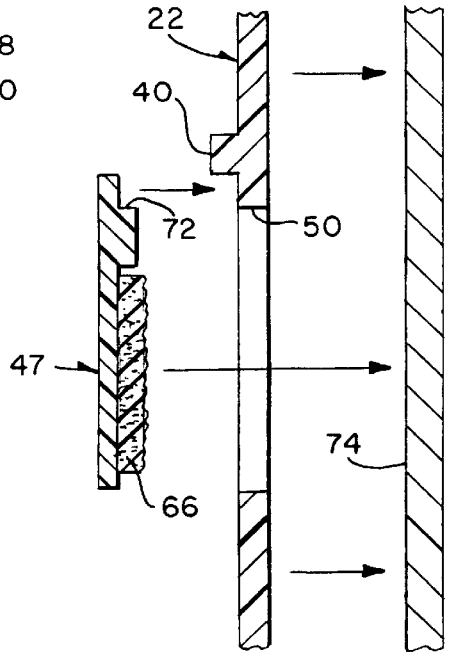
FIG. 8 is a diagrammatic exploded view of the action of the wall hanger.

The action of the wall hanger 47 which allows the display device/storage rack component 20 to be hung vertically on a vertical wall 74 can best be seen in FIG. 8, and as such will be discussed with reference thereto.

STEP 1: Remove the wall hanger 47 from the base 22, by severing the wall hanger runners 48.

STEP 2: Attach the wall hanger 47 to the vertical wall 74, by affixing the double faced adhesive pad 66 on the inner surface of the body portion 64 of the w hanger 47 to the vertical wall 74, with the nose portion 68 of the wall hanger 47 facingupwardly.

STEP 3: Position the wide portion 50 of the specifically-configured cutout 42 in the base 22 over the wall hanger 47.

STEP 4: Lower the display device/storage rack component 20 onto the wall hanger 47, with the continuous support ridge 40 resting on the nose portion 68 of the wall hanger 47, and with the uppermost edge of the specifically-configure cutout 42 in the base 22 resting on the wall hanger nose ridge 72 of the wall hanger 47.

Figure 9:
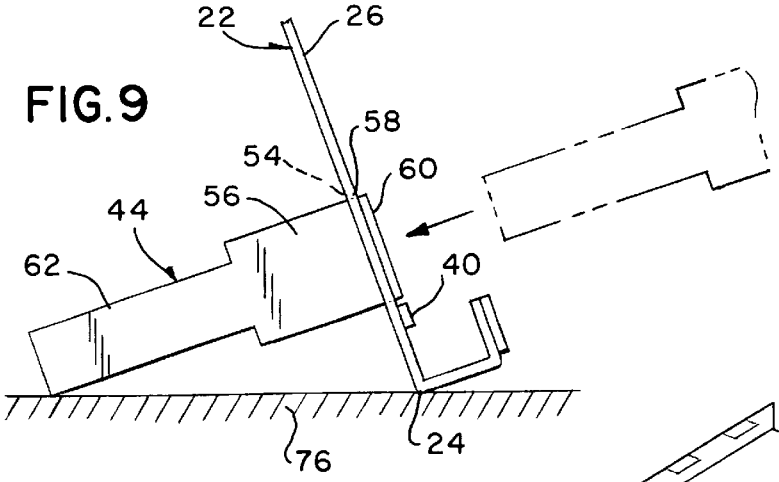
FIG. 9 is a diagrammatic exploded view of the action of the easel stand.

The action of the easel stand 44 which allows the display device/storage rack component 20 to be displayed inclined on a horizontal surface 76 can best be seen in FIG. 9, and as such will be discussed with reference thereto.

STEP 1: Remove the easel stand 44 from the base 22, by severing the easel stand runners 46.

STEP 2: Pass the narrow portion 62 of the easel stand 44 through the easel stand slot 54 in the base 22, from the inner surface 26 of the base 22, with the wide portion 56 of the easel stand 44 passing through the easel stand slot 54 in the base 22 until the easel stand ridge 60 on the edge 58 of the wide portion 56 of the easel stand 44 abuts against the inner surface 26 of the base 22.

STEP 3: Rest the free end of the narrow portion 62 of the easel stand 44 and the corresponding edge of the pair of opposing edges 24 of the base 22 on the horizontal surface 76.

Figure 10:
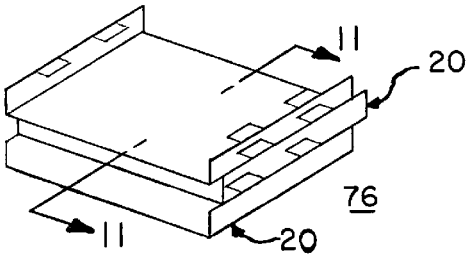
FIG. 10 is a diagrammatic perspective view of a plurality of present inventions stacked and interlocked.

The manner of stacking and interlocking a plurality of the display device/storage rack component 20 on the horizontal surface 76 can best be seen in FIGS. 10 and 11, and as such will be discussed with reference thereto.

STEP 1: Rest the base 22 of a display device/storage rack component 20 on the horizontal surface 76.

STEP 2: Position the base 22 of a subsequent display device/storage rack component 20 on top of the display device/storage rack component 20, with the two pair of overhanging ledges 36 of the display device/storage rack component 20 entering the two pair of notches 32 in the base 22 of the subsequent display device/storage rack component 20.

STEP 3: Slide the subsequent display device/storage rack component 20 on the display device/storage rack component 20, until the two pair of brackets 34 of the display device/storage rack component 20 abut against the base 22 of the subsequent display device/storage rack component 20 so as to interlock and stagger the subsequent display device/storage rack component 20 on the display device/storage rack component 20.

STEP 4: Repeat steps 2 and 3 for additional subsequent display device/storage rack components 20.

It will be understood that each of the elements described above, or two or more together, may also find a useful application in other types of constructions differing from the types described above.

While the invention has been illustrated and described as embodied in a display device/storage rack component, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A combination display device and storage rack component comprising:

a) a base; said base being flat, generally rectangular-shaped, and having a pair of opposing edges and an inner surface, said inner surface having a width and being for facing a viewing surface of an object housed in said combination display device and storage rack component; said base further having a first pair and a second pair of notches therein, with said first pair of notches being spaced-apart from the second pair of notches; each said pair of notches communicating with a respective one of said edges of said pair of opposing edges;

b) a pair of side walls extending upwardly from said base;

c) hanging means for hanging said combination display device and storage rack component on a vertical wall;

d) resting means for resting said combination display device and storage rack component on a horizontal surface inclined with respect to said horizontal surface; said base further having a specifically configured cutout therein having an uppermost edge, said resting mean comprising an easel stand, said easel stand being disposed within said cutout and detachably attached to said base by easel stand runners, and said easel stand being integrally formed with said base; said hanging means comprising a wall hanger, said wall hanger being disposed within specifically configured cutout, said wall hanger having a width and being detachably attached to said base by wall hanger runners, said wall hanger being integrally formed with said base; said wall hanger having a body portion being generally square-shaped, said wall hanger runners being attached to said body portion; said body portion of said wall hanger further having an inner surface being coplanar with said inner surface of said base and having a double faced adhesive pad adhered on said inner surface of said body portion;

e) stacking and interlocking means for stacking and interlocking a plurality of said combination display device and storage rack components;

f) three support ridges being spaced-apart from each other, aligned with each other, and each being generally rectangular-parallelepiped-shaped; said three support ridges being disposed on said inner surface of said base parallel to and spaced slightly inwardly from one of said pair of opposing edges of said base and adapted to support one end of the viewing surface of the object housed in said combination display device and storage rack component; one of said three support ridges being disposed between one of said first pair and said second pair of notches and a remaining pair of said three support ridges being disposed outboard of said one of said first pair and said second pair of notches; and g) a continuous support ridge having a center and being generally rectangular-parallelepiped-shaped and disposed on said inner surface of said base and extending across said width of said inner surface of said base and being parallel to and spaced slightly inwardly from the other of said first pair and said second pair of notches and adapted to support another end of the viewing surface of the object housed in said combination display device and storage rack component; said wall hanger further having a nose portion being generally triangular-shaped and extending coplanarly from said body portion of said wall hanger toward said continuous support ridge; said wall hanger further having a wall hanger ridge being rectangular-parallelepiped-shaped and parallel to said continuous support ridge, said wall hanger ridge having a height substantially equal to a height of said continuous support ridge and being disposed on said inner surface of said body portion of said wall hanger at a meeting of said body portion of said wall hanger and said nose portion of said wall hanger and extending across said width of said wall hanger; said wall hanger further having a wall hanger nose ridge being triangular-shaped and extending said wall hanger ridge of said wall hanger at a midpoint of said wall hanger ridge toward said nose portion of said wall hanger, said wall hanger nose ridge having a height substantially equal to a height of said wall hanger ridge.

2. The combination display device and storage rack component as defined in claim 1, wherein said combination display device and storage rack component is integrally formed of transparent plastic.

3. The combination display device and storage rack component as defined in claim 1, wherein each said side wall of said pair of side walls is generally rectangular-shaped and extends perpendicularly upwardly from a respective one of said pair of opposing edges of said base and is adapted to face the object housed in said combination display device and storage rack component; each said side wall of said pair of side walls terminates in a free edge.

4. The combination display device and storage rack component as defined in claim 3, wherein said stacking and interlocking means further includes two pair of brackets; each said pair of brackets of said two pair of brackets extends slightly upwardly from said free edge of a respective one of said pair of side walls and then inwardly in alignment with one of said first pair and said second pair of notches.

5. The combination display device and storage rack component as defined in claim 4, wherein said stacking and interlocking means further includes two pair of overhanging ledges, each of said ledges being rectangular-shaped and has an area that is slightly smaller than an area of a respetive one of said notches in said base; each said overhanging ledge of said two pair of overhanging ledges extends across an inward portion of a respective one of said brackets in alignment with said respective one of said notches in said base for stacking a plurality of said combination display device and storage rack components.

6. The combination display device and storage rack component as defined in claim 1, wherein said specifically configured cutout in said base has a wide portion that is rectangular-shaped and disposed slightly inwardly of said continuous support ridge.

7. The combination display device and storage rack component as defined in claim 6, wherein said specifically configured cutout in said base further has a narrow portion that is rectangular-shaped and narrower than said wide portion of said specifically configured cutout in said base and extends away from one edge of said wide portion of said specifically configured cutout in said base.

8. The combination display device and storage rack component as defined in claim 7, wherein said base further includes an easel stand slot therein that originates at said continuous support ridge and is spaced from said wide portion of said specifically configured cutout in said base.

9. The combination display device and storage rack component as defined in claim 8, wherein said easel stand is flat and substantially T-shaped and has a wide portion that is generally rectangular-shaped and fills a portion of said wide portion of said specifically configured cutout in said base; said wide portion of said easel stand has an edge that is parallel to said continuous support ridge; an easel stand ridge extends from said edge of said wide portion of said easel stand, said easel stand ridge having a height substantially equal to said height of said continuous support ridge.

10. The combination display device and storage rack component as defined in claim 9, wherein said wall hanger is disposed adjacent to said wide portion of said easel stand and substantially fills a remaining portion of said wide portion of said specifically configured cutout in said base.

11. The combination display device and storage rack component as defined in claim 9, wherein said easel stand further has a narrow portion that has a free end and is generally rectangular-shaped and extends coplanarly from and is narrower than said wide portion of said easel stand and substantially fills said narrow portion of said specifically configured cutout in said base.

* * * * *